United States Patent [19]

Valansot

[11] 4,250,434

[45] Feb. 10, 1981

[54] PRESSURE-RESPONSIVE ELECTRIC SWITCH

[76] Inventor: Jean Valansot, 14 re Cordemoy, Royat (Puy-de-Dome), France

[21] Appl. No.: 904,887

[22] Filed: May 11, 1978

[30] Foreign Application Priority Data

May 17, 1977 [FR] France ..... 77 15822

[51] Int. Cl.[3] ..... H01H 35/24; H05B 37/00

[52] U.S. Cl. ..... 315/362; 200/81 H; 200/83 Z; 200/86 A; 307/144; 340/573

[58] Field of Search ..... 340/573, 611, 626, 665, 340/666; 200/81 R, 81 H, 83 R, 83 Z, 86 A; 362/802; 315/362; 307/144, 118

[56] References Cited

U.S. PATENT DOCUMENTS

| | | | |
|---|---|---|---|
| 2,783,325 | 2/1957 | Luckey | 200/86 A X |
| 2,795,668 | 6/1957 | Puckett | 200/86 A X |
| 3,260,812 | 7/1966 | Miller | 200/86 A X |
| 3,781,843 | 12/1973 | Harrison et al. | 340/573 |

*Primary Examiner*—Eugene R. LaRoche
*Attorney, Agent, or Firm*—Michael Ebert

[57] ABSTRACT

A pressure-responsive electric switch assembly provided with an elongated pneumatic tube of elastomeric foam material impermeable to air, one end of the tube being plugged and the other having a sleeve therein whose inner end is covered by a membrane to thereby seal the tube. The tube has a relatively thick, deformable wall whereby a slight manual pressure applied thereto gives rise to a substantial change in the internal volume of the sealed tube to dilate the membrane. A microswitch disposed within the sleeve has an actuating element operatively coupled to the membrane such that when manual pressure is applied to the tube, the switch is actuated.

9 Claims, 6 Drawing Figures

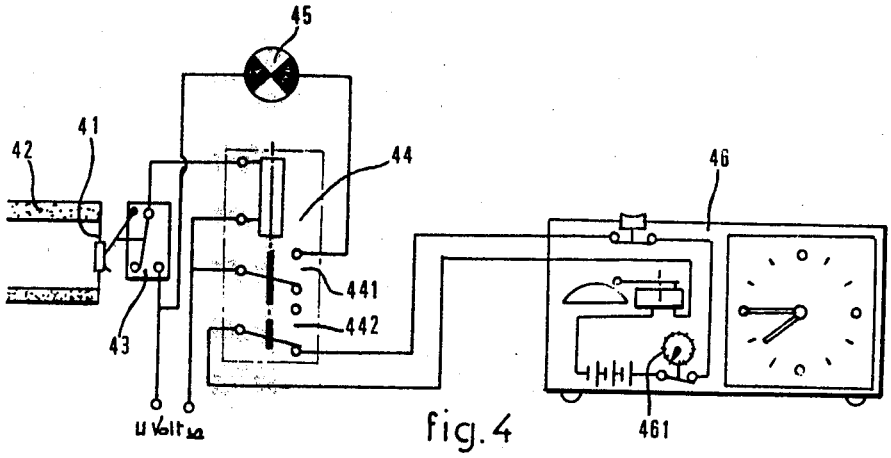
fig. 4
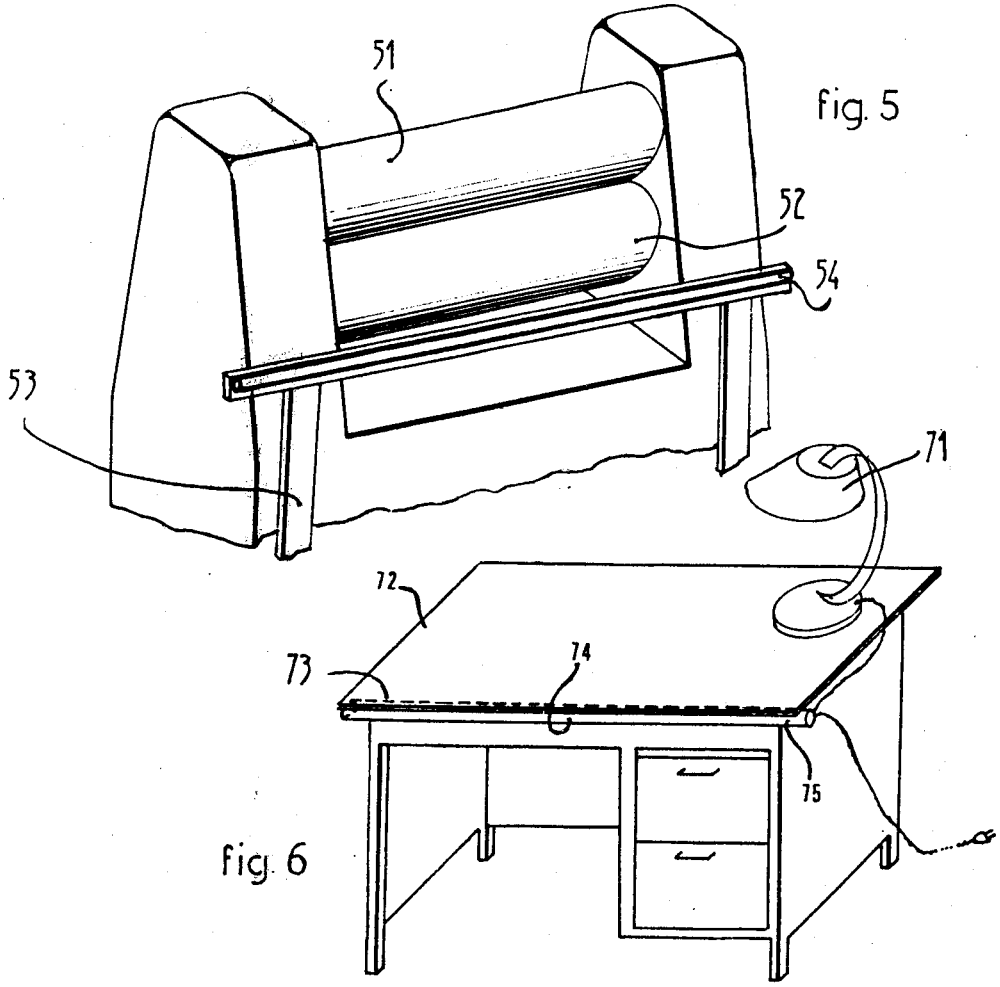
fig. 5
fig. 6

PRESSURE-RESPONSIVE ELECTRIC SWITCH

The present invention relates to control members and more particularly to a control member or device which is sensitive to manual pressure and is relatively spread out in space; a few cases of particularly interesting application of the device are given by way of example and concern both the field of furniture and of illumination.

There is already known a first type of control member formed of a substantially spherical enclosure at times referred to as a "bulb", intended to transmit pneumatically pressure exerted by the hand or foot, for instance which results in a temporary deformation of the enclosure; the bulb is in general located at the end of a small flexible tube which serves simultaneously as attachment for the bulb and conduit for the fluid (air or the like) contained within the bulb; it is convenient to define such a device as being localized in space. There is also known a second type of control member or device which comprises an enclosure having deformable tubular walls the outside diameter of which is on the order of 1–2 cm and the length of which may be one or more meters; such an enclosure can be deformed temporarily by a force which it transmits to one of its ends where a suitable detector, such as a pressure detector, for instance, can take note of the force as a control signal; it is convenient to define such a device as being spread out in space. Such devices serve, for instance, to detect the passage of a vehicle over a road upon the entrance into a gas station. In this use, the fluid contained in the enclosure is generally a liquid and the enclosure itself is relatively elastically resistant, to such an extent that it is frequently impossible to deform it by hand.

The object of the present invention is, in general, the new application of an existing product now used in particular for the thermal insulating of tubular conduits; this product is in the form of a tube of cellular elastomeric material having in profile the shape of a relatively thick circular ring; such a tube is impermeable to gases, it is light and although very flexible it maintains a suitable natural shape.

In accordance with the present invention, a control device comprising an enclosure with deformable tubular bulb, which is extended in space and intended to be deformed temporarily by a force constituting an initial control signal is characterized by the fact that the said tubular wall of the enclosure is formed of a cellular elastomeric material, with the result primarily that the force of deformation can be a relatively small force such as a manual force while permitting the tubular wall to maintain itself in a suitable natural position; the cellular elastomer which constitutes the tube may, for instance consist of foam rubber or else of an expanded flexible polyurethane, which is an electrically insulating material which imparts safety to the device.

The control device or member of the invention preferably transmits the control to a cybernetic chain by means of a membrane which closes off one of the ends of the said tubular enclosure, said membrane being in mechanical relationship with an electric microcontact of maintained or nonmaintained action contained within the said cybernetic chain; the second end of the tube may be closed either by a transmission membrane such as the one indicated above or by a solid part forming a plug. It will be noted that the tubular wall described above differs, with respect to the results which it makes it possible to obtain, from a flexible tube, for instance a thin-walled tube, by the fact that even a punctiform pressure produces a rather extensive deformation of the wall and thereby a rather substantial relative variation of the inside volume of the enclosure.

The invention is applicable to the control of electric lights; it can be applied to any manually initiated forms of control; finally, it will be noted that the field of use of the invention is in particular that in which certain special conditions relating either to the condition of the person who is to initiate the control or the environment of said person would prevent a precise rapid locating of a spatially localized control member.

One particularly interesting first application of the device of the invention resides, in accordance with what has just been stated, in the field of control and particularly the control of lighting, bed lamps or other bedroom lights; it is well known, as a matter of fact, that a person who has been asleep when waking up frequently has difficulty in finding the control button or switch for the lights; thus, in accordance with the present invention, the device described above can be arranged within the reach of the hand of a person who is sleeping, advantageously towards the head of the bed, with which it can be associated in a very esthetically pleasing manner; as a result of this arrangement a person when awaking can, without groping, readily turn on a bed lamp.

A second application also relates to the application of the device described above for the control of household lights and resides in the control of a desk lamp, the device of the invention being advantageously arranged below and along the front portion of the top of such desk.

A third application resides in a stop control constituting a safety for machine tools.

The present invention will be better understood and details disclosing it will become evident from the description which will now be given of various embodiments with reference to the accompanying figures, in which FIG. 1 is a partial longitudinal sectional view of one end of a control device in accordance with the invention;

FIG. 4 is a diagrammatic representation of a cybernetic chain which is controlled by the manual control member of the invention, for controlling the turning on of a bed lamp when the alarm of an alarm clock stops.

FIG. 5 shows a machine tool equipped with a device in accordance with the invention, which assures safety for the user; and FIG. 6 is an illustration of the application of the device of FIGS. 1 and 2 for controlling the turning on of a desk lamp.

Figure 2:
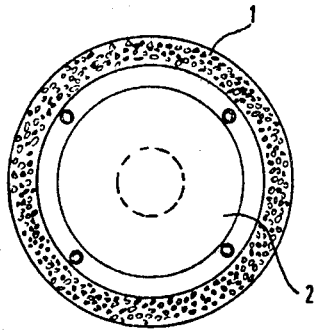
FIG. 2 is a front sectional view thereof.
Figure 1:
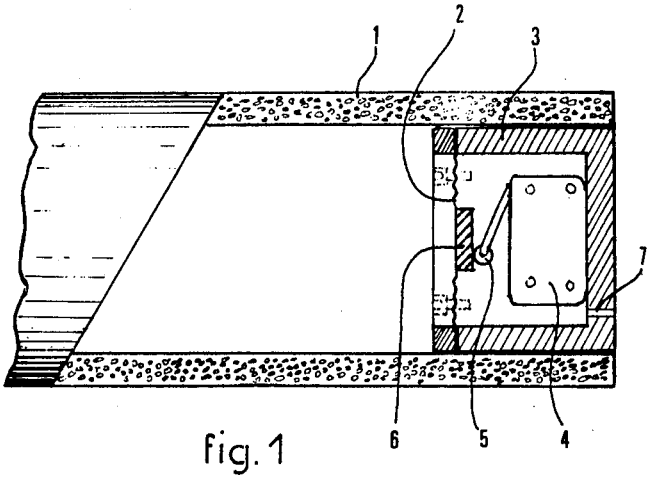

Referring to FIGS. 1 and 2, the control device consists primarily of a tubular-wall enclosure 1 formed of a cellular material such as foam rubber or flexible polyurethane foam. This tubular wall is in fact a hollow part in the shape of a circular ring known for purposes of thermal insulation of which the present invention makes a new application. Tests have confirmed the ability of such a cellular material having closed cells to produce a manually deformable enclosure; even a slight manual pressure results in a rather substantial change in the inside volume of the enclosure; of course this change in inside volume of the enclosure results in a change in the relative pressure within the enclosure which is greater the shorter the tube which forms the wall of the enclosure. The fact that the enclosure is made of a cellular material and that it is relatively thick as compared with its diameter seem to be the reasons for this technically important result.

A membrane 2 arranged on a membrane-holding sleeve 3 closes off at least one of the ends of the tube 1 while the other end can be closed by a simple plug; a microcontact 4 is advantageously arranged in the membrane-holder sleeve and the sensor 5 of said microcontact can be actuated by the membrane; the mechanical connection between the membrane and the sensor 5 is advantageously produced by means of a push plate 6 which is rigidly attached to the membrane. In the event that the outer end of the sleeve is closed off for esthetic reasons, as is true in the case of the sleeve shown in the figure, it is preferable to provide an orifice such as 7 for placing the inside of the sleeve into communication with the atmosphere. For example, the membrane can suitably consist of a sheet of natural rubber, so-called "blonde rubber", of 0.1 to 0.3 mm; its useful surface, suitable for a tube having approximately an inside diameter of 4 cm and a thickness of 1 cm, will be about 12 $cm^2$; the force exerted by the membrane on the sensor is then greater than 25 g, which in general is sufficient to actuate the microcontact and this force can be developed by a simple manual push on the tube which may have a length of up to 20 meters. It will be noted that it is in no way indispensable that the membrane be arranged at the end of the tube, but it could just as well be incorporated in a piezo-sensitive capsule which is spaced from the end of the enclosure-forming tube and connected to said end by a connecting tube of much smaller diameter.

Figure 3:
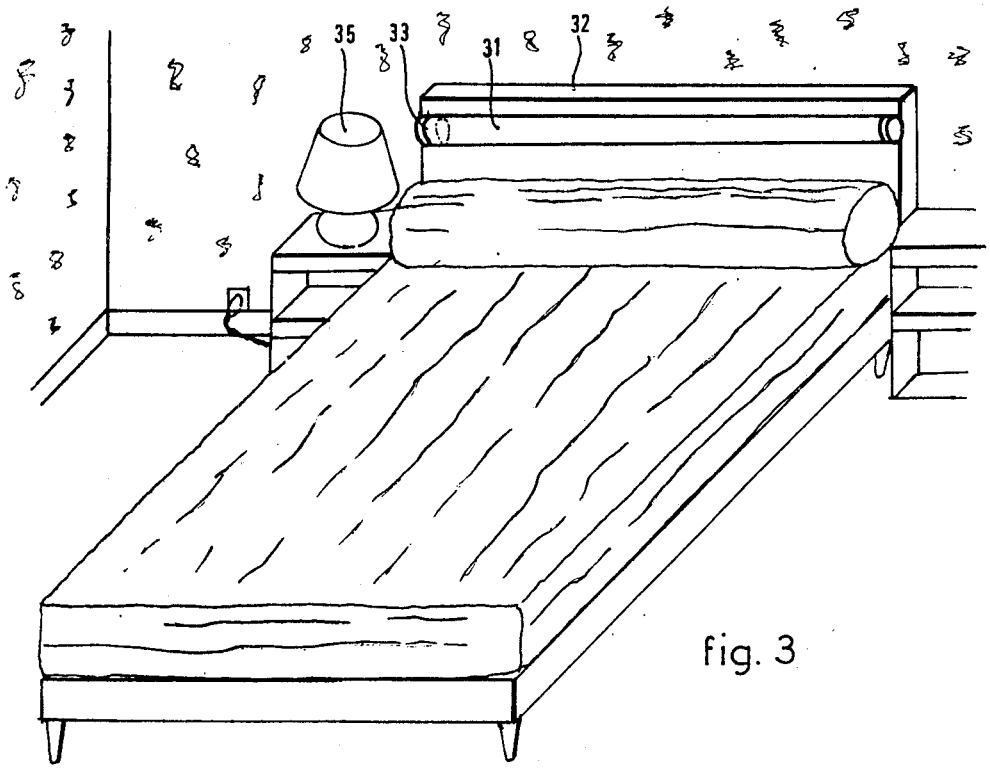
FIG. 3 is an illustration of an application of the device of the preceding figures for the control of a bed lamp.

In FIG. 3, a control member 31 like the one shown in the preceding figures is arranged longitudinally against the headboard 32 of a bed at a certain distance and certain height above the bedding so that it is out of the way of the head of the sleeping person; a membrane and a microcontact are arranged at the end 33 of said member so as to control the turning on and off of a bed lamp 35. It will be noted that the shape of the control device 31 harmonizes rather well with the lines of a modern bed; it will also be noted that for purposes of appearance the device may be covered with fabric or leather which is identical to or harmonizes, for instance with a bolster of the bed.

FIG. 4 diagrammatically shows a cybernetic chain comprising a membrane 41 arranged at the end of a device 42 similar to that shown in the preceding figures, a microcontact 43 mechanically connected with the membrane 41, a remote switch 44 with two outlets 441 and 442, controlled by the microcontact; the outlet 441 constitutes a feed terminal of a bed lamp 45 while the outlet 442 constitutes a switch mounted on the electric alarm circuit of an alarm clock 46; from the wiring diagram of the remote switch it will be noted that when the bed lamp 45 is turned off, the alarm can be actuated by closure of the circuit by the alarm control member 461 (as in the case of the figure) and that the lighting of the lamp results in the stopping of the alarm.

In FIG. 5, a machine tool, a so-called calender, has two rotary cylinders 51 and 52 driven in rotation by a powerful motor; this machine is used to knead elastomers, rubber, etc., in order to make them flexible or incorporate adjuvants in them; its use is rather dangerous due to the fact that the user may introduce his hands between the rollers; a barrier 53 is placed between the machine and the user and a control member 54 in accordance with the invention is placed on the barrier; the slightest pressure exercised by the user on this member brings about the stopping of the machine and assures the protection of the user.

In FIG. 6 which illustrates another application of the spatially extended control member of the invention, a desk lamp 71 is arranged on a desk 72 and a device 74 in accordance with the invention, such as the deformable enclosure of FIGS. 1 and 2, is arranged below and along the front portion 73 of the desk top; a membrane, a micro-switch and a remote switch form a cybernetic chain for the control of the turning on and off of the lamp 71 and are contained, for instance, in the end 75 of the member 74. This application of the device in accordance with the invention makes it possible to turn the lamp on or off without having to stretch one's arm over the desk as is customarily the case.

The invention can furthermore be used for controlling the opening of a bank door from any point of the tellers' windows.

It should finally be understood that the present invention is not limited to the applications which have been indicated by way of illustration above nor to the shape of a circular ring for the control member but that it extends to any other shape and any other arrangement of the control member, the scope of the invention being defined by the following claims.

I claim:

1. A pressure-responsive electric switch assembly comprising:

A an elongated pneumatic tube having a circular cross section and formed of elastomeric cellular foam material impermeable to air, one end of the tube being sealed by a plug;

B a sleeve inserted in the other end of the pneumatic tube, the inner end of the sleeve being covered by a membrane to seal the other end of the tube, said tube having a relatively thick deformable wall thereby a slight manual pressure applied thereto gives rise to a substantial change in the internal volume of the sealed tube to dilate said membrane; and C a microswitch disposed within said sleeve and having an actuating element operatively coupled to said membrane whereby when said manual pressure is applied, said switch is actuated.

2. An assembly as set forth in claim 1, wherein said tube is formed of foam rubber.

3. An assembly as set forth in claim 1, wherein said tube is formed of polyurethane.

4. An assembly as set forth in claim 1, wherein said membrane is formed of natural rubber.

5. An assembly as set forth in claim 1, wherein said membrane has a push plate secured thereto which is engaged by said actuating element.

6. An assembly as set forth in claim 1, wherein said tube has an internal diameter of about 4 cm and a wall thickness of about 1 cm.

7. An assembly as set forth in claim 1, wherein the outer end of the sleeve is closed by a disc confining said microswitch in a sleeve chamber, said disc having an aperture therein to vent said chamber and thereby permit dilation of said membrane.

8. An assembly as set forth in claim 1, wherein said tube is mounted across the headboard of a bed and said microswitch is electrically interposed between a lamp and a power source, whereby said lamp is controlled simply by applying slight pressure to said tube at any point therealong.

9. An assembly as set forth in claim 18, wherein said microswitch is also connected to the alarm circuit of an electric alarm clock which, when said switch acts to turn on said lamp, it simultaneously serves to turn off the alarm of the alarm clock.

* * * * *